US010718526B2

(12) United States Patent
Neal et al.

(10) Patent No.: US 10,718,526 B2
(45) Date of Patent: Jul. 21, 2020

(54) COOKTOP BURNER ILLUMINATION

(71) Applicant: Midea Group Co., Ltd., Beijiao, Shunde, Foshan (CN)

(72) Inventors: Vern A. Neal, Louisville, KY (US); Mark W. Wilson, Simpsonville, KY (US); Daniel Joseph Trice, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 245 days.

(21) Appl. No.: 15/941,796

(22) Filed: Mar. 30, 2018

(65) Prior Publication Data

US 2019/0301745 A1 Oct. 3, 2019

(51) Int. Cl.

| | |
|---|---|
| ***G08B 21/00*** | (2006.01) |
| ***F24C 7/08*** | (2006.01) |
| ***F24C 15/10*** | (2006.01) |

(52) U.S. Cl.

CPC ..... *F24C 7/083* (2013.01); *F24C 15/10* (2013.01)

(58) Field of Classification Search

CPC ..... F24C 3/124; F24C 3/126; F24C 3/082; F24C 3/085; F24C 3/122; F24C 7/083; F24C 7/086; F24C 3/12; F24C 7/082; F24C 15/10; F24C 15/106; F24C 15/2064; F24C 1/04; A47J 27/10; A47J 27/62; A47J 36/321; F23N 2241/08; F23N 1/005; F23N 1/002; F23N 1/022; F23N 2223/36; F23N 2223/52; F23N 2235/12; F23N 2235/16; F23N 2239/04; F23N 5/022; F23N 5/04;

(Continued)

(56) References Cited

U.S. PATENT DOCUMENTS

| | | | |
|---|---|---|---|
| 8,587,444 | B2 | 11/2013 | Cadima et al. |
| 8,667,958 | B2 | 3/2014 | Cadima |

(Continued)

FOREIGN PATENT DOCUMENTS

| | | | |
|---|---|---|---|
| CN | 201262508 | Y | 6/2009 |
| CN | 201310941 | Y | 9/2009 |

(Continued)

OTHER PUBLICATIONS

Panasonic "Panasonic launches innovative cooktop in the Middle East" Middle East Company News [Dubai], Nov. 8, 2006.

(Continued)

*Primary Examiner* — Daniel Previl
(74) *Attorney, Agent, or Firm* — Middleton Reutlinger

(57) ABSTRACT

An illumination system for a cooking appliance is capable of illuminating generally downwardly onto the cooktop burners of the cooking appliance using multiple illumination schemes. One illumination scheme may be used to indicate which cooktop burner is controlled by a particular burner control that a user is interacting with prior to activation of the cooktop burner, e.g., to indicate to a user that a burner control that the user has touched or is otherwise proximate to controls a particular cooktop burner. Another illumination scheme may be used to indicate which cooktop burner is being adjusted when a user is adjusting a particular burner control, e.g., to indicate to a user that a burner control that the user is currently manipulating is changing the output of a particular cooktop burner.

28 Claims, 3 Drawing Sheets

(58) Field of Classification Search
CPC ... F23N 5/10; F23N 5/14; F23D 14/00; F23D 14/06; F23D 23/00; G06F 3/04847; G06F 3/04883; G06F 3/0482; G06F 3/04842; G06F 3/0486; G06F 2203/014; G06F 3/016; G06F 3/04886; H05B 2213/05; H05B 3/68; H05B 6/12; H05B 1/0261; H05B 3/74; H05B 6/065; B23P 15/001; F16K 5/0407; F16K 5/103; G05G 1/105; G01N 25/08; G05B 13/0275; G05B 15/02; G05D 23/1913; G05D 23/1917; H03K 17/96; H03K 17/962; H03K 2217/96062; H03K 2217/96066; Y02B 40/166
USPC ..... 340/540, 539.22, 552, 555, 556, 585, 340/588, 621, 622, 692, 5.21, 286.08, 340/286.09
See application file for complete search history.

(56) References Cited

U.S. PATENT DOCUMENTS

| | | | |
|---|---|---|---|
| 8,803,048 | B2 | 8/2014 | Bassill et al. |
| 8,976,158 | B2 | 3/2015 | Eriksson et al. |
| 9,006,614 | B2 | 4/2015 | Donarski |
| 2005/0057529 | A1 | 3/2005 | Mairal Serrano |
| 2009/0173730 | A1* | 7/2009 | Baier ..... F24C 7/083 219/446.1 |
| 2012/0132191 | A1* | 5/2012 | Cadima ..... F24C 3/085 126/39 R |
| 2012/0138590 | A1 | 6/2012 | Brosnan et al. |
| 2013/0270251 | A1 | 10/2013 | Furuti et al. |
| 2014/0210793 | A1* | 7/2014 | Eriksson ..... F24C 7/083 345/175 |
| 2014/0295357 | A1* | 10/2014 | McAfee ..... H05B 6/12 431/6 |
| 2016/0208933 | A1* | 7/2016 | Cadima ..... F16K 5/0407 |
| 2017/0027378 | A1 | 2/2017 | Millett |
| 2018/0206311 | A1* | 7/2018 | Yantis ..... F24C 7/082 |

FOREIGN PATENT DOCUMENTS

| | | | |
|---|---|---|---|
| CN | 101818919 | A | 9/2010 |
| CN | 106594808 | A | 4/2017 |
| CN | 107620986 | A | 1/2018 |
| DE | 102012216936 | A1 | 10/2013 |
| EP | 1020686 | A1 | 7/2000 |
| WO | 2015078643 | A1 | 6/2015 |

OTHER PUBLICATIONS

International Search Report and Written Opinion of PCT Ser. No. PCT/CN2018/125204, dated Mar. 27, 2019.

* cited by examiner

COOKTOP BURNER ILLUMINATION

BACKGROUND

Cooktops, whether as standalone cooking appliances or incorporated into other cooking appliances such as ranges, generally incorporate multiple heating elements, generally referred to as burners, which are generally controlled by individual burner controls such as knobs. Cooktop burners may be heated using various types of technologies, e.g., using gas, resistive electrical elements or inductive electrical elements, and while in some instances the cooktop burners may incorporate surfaces upon which pots and pans may be directly placed, in other instances the cooktop burners may be covered with grates or may be disposed below glass surfaces upon which pots and pans may be placed.

Given the standard depth of many countertops as well as the typical size of the pots and pans conventionally used with cooktops, the cooktops of many cooking appliances incorporate 4, 5 or 6 burners arranged in a two-dimensional array. The cooktop burners may also vary from one another in size and/or output capacity to accommodate different cooking needs. On the other hand, burner controls such as knobs are often arranged into a linear array, typically either on a backsplash control panel at the rear of a cooking appliance or along the front of the cooking appliance (e.g., on a top or front surface thereof).

In some instances, however, it is not immediately apparent which cooktop burner is controlled by which burner control. Conventionally, graphical icons have been printed on a cooking appliance proximate each burner control to indicate which cooktop burner is controlled by which burner control. However, the graphical icons are not often particularly distinctive, and can lead to a user accidentally interacting with the wrong burner control when attempting to operate a particular cooktop burner.

Therefore, a need exists in the art for an improved manner of facilitating user control over the cooktop burners of a cooking appliance.

SUMMARY

The herein-described embodiments address these and other problems associated with the art by providing an illumination system for a cooking appliance that is capable of illuminating generally downwardly onto the cooktop burners of the cooking appliance using multiple illumination schemes to convey various types of feedback to a user interacting with the cooking appliance. For example, one illumination scheme may be used to indicate which cooktop burner is controlled by a particular burner control that a user is interacting with prior to activation of the cooktop burner, e.g., to indicate to a user that a burner control that the user has touched or is otherwise proximate to controls a particular cooktop burner. Moreover, another illumination scheme may be used to indicate which cooktop burner is being adjusted when a user is adjusting a particular burner control, e.g., to indicate to a user that a burner control that the user is currently manipulating is changing the output of a particular cooktop burner.

Therefore, consistent with one aspect of the invention, a cooking appliance may include a plurality of cooktop burners, a plurality of burner controls, each burner control controlling a respective cooktop burner among the plurality of cooktop burners, an illumination system positioned above the plurality of cooktop burners to illuminate generally downwardly onto the plurality of cooktop burners, and a controller configured to control the illumination system in response to user interaction with the plurality of burner controls. The controller may be configured to control the illumination system to, during user interaction with a first burner control among the plurality of burner controls and prior to activation of a first cooktop burner among the plurality of cooktop burners that is controlled by the first burner control, illuminate the first cooktop burner with the illumination system using a first illumination scheme, and during user adjustment of the first burner control while the first cooktop burner is active, illuminate the first cooktop burner with the illumination system using a second illumination scheme that is different from the first illumination scheme.

In addition, in some embodiments, the cooking appliance is a range or cooktop. In some embodiments, the illumination system is disposed in a vent hood or an over-the-range oven. Also, in some embodiments, the illumination system is separate from a vent hood or an over-the-range oven.

Moreover, in some embodiments, the illumination system includes one or more LED illuminating elements, incandescent illuminating elements, halogen illuminating elements, fluorescent illuminating elements, or laser illuminating elements. In addition, in some embodiments, the illumination system includes an illuminating element with a variable beam width that is adjustable to match a size of a cooktop burner among the plurality of cooktop burners. In some embodiments, the illumination system includes an illuminating element with a variable orientation that is adjustable to direct a beam position to match a position of a cooktop burner among the plurality of cooktop burners. Moreover, in some embodiments, the illumination system includes an illuminating element and a movable mirror to reflect a beam from the illuminating element at any of the plurality of cooktop burners, and where the controller is configured to selectively illuminate each of the plurality of cooktop burners by modulating the beam from the illuminating element.

In some embodiments, the first illumination scheme is a solid illuminating scheme and the second illumination scheme is a flashing illumination scheme. Also, in some embodiments, the first illumination scheme illuminates the first cooktop burner with a first color and the second illumination scheme illuminates the first cooktop burner with a second color. In some embodiments, the controller is configured to vary the second illumination scheme in response to a position of the first burner control.

In addition, in some embodiments, the controller is further configured to control the illumination system to, in an absence of user interaction with the first burner control while the first cooktop burner is active, illuminate the first cooktop burner with a third illumination scheme. Further, in some embodiments, the controller is configured to vary the third illumination scheme in response to a temperature of the first cooktop burner.

In addition, in some embodiments, the controller is further configured to control the illumination system to, in response to a temperature of the first cooktop burner meeting a hot surface criterion when the first cooktop burner is inactive, illuminate the first cooktop burner with a third illumination scheme. Further, in some embodiments, the controller is configured to vary the third illumination scheme in response to the temperature of the first cooktop burner.

In addition, some embodiments may also include a user detection system configured to sense user interaction with the first burner control, where the controller is detect the user interaction with the first burner control using the user detection system. In addition, in some embodiments, the user detection system includes one or more ultrasonic proximity sensors.

Consistent with another aspect of the invention, a cooktop illumination apparatus may include an illumination system configured to be positioned above a plurality of cooktop burners of a cooking appliance to illuminate generally downwardly onto the plurality of cooktop burners, and a controller configured to control the illumination system in response to user interaction with a plurality of burner controls of the cooking appliance. The controller may be configured to control the illumination system to, during user interaction with a first burner control among the plurality of burner controls and prior to activation of a first cooktop burner among the plurality of cooktop burners that is controlled by the first burner control, illuminate the first cooktop burner with the illumination system using a first illumination scheme, and during user adjustment of the first burner control while the first cooktop burner is active, illuminate the first cooktop burner with the illumination system using a second illumination scheme that is different from the first illumination scheme.

Also, in some embodiments, the controller is in wireless communication with the cooking appliance to detect user interaction with each burner control among the plurality of burner controls.

Consistent with another aspect of the invention, a method of operating a cooking appliance of the type including a plurality of cooktop burners and a plurality of burner controls, each controlling a respective cooktop burner among the plurality of cooktop burners, may include, during user interaction with a first burner control among the plurality of burner controls and prior to activation of a first cooktop burner among the plurality of cooktop burners that is controlled by the first burner control, and with an illumination system positioned above the plurality of cooktop burners to illuminate generally downwardly onto the plurality of cooktop burners, illuminating the first cooktop burner using a first illumination scheme, and during user adjustment of the first burner control while the first cooktop burner is active, and with the illumination system, illuminating the first cooktop burner using a second illumination scheme that is different from the first illumination scheme.

In some embodiments, the illumination system includes an illuminating element and a movable mirror to reflect a beam from the illuminating element at any of the plurality of cooktop burners, the method further including selectively illuminating each of the plurality of cooktop burners by modulating the beam from the illuminating element.

In addition, in some embodiments, the first illumination scheme is a solid illuminating scheme and the second illumination scheme is a flashing illumination scheme. Further, in some embodiments, the first illumination scheme illuminates the first cooktop burner with a first color and the second illumination scheme illuminates the first cooktop burner with a second color.

Some embodiments may also include varying the second illumination scheme in response to a position of the first burner control. In addition, some embodiments may further include controlling the illumination system to, in an absence of user interaction with the first burner control while the first cooktop burner is active, illuminate the first cooktop burner with a third illumination scheme.

Some embodiments may further include varying the third illumination scheme in response to a temperature of the first cooktop burner. In addition, some embodiments may also include controlling the illumination system to, in response to a temperature of the first cooktop burner meeting a hot surface criterion when the first cooktop burner is inactive, illuminate the first cooktop burner with a third illumination scheme. Some embodiments may also include varying the third illumination scheme in response to the temperature of the first cooktop burner.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
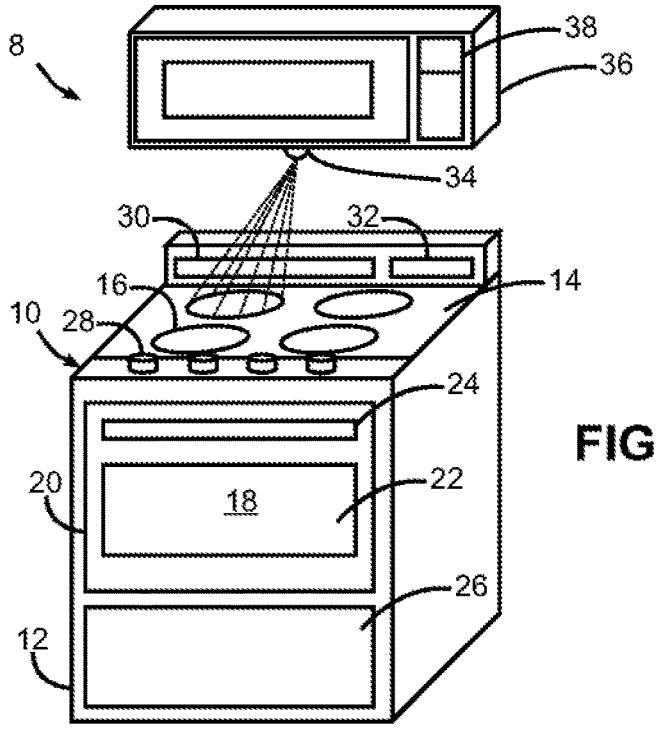
FIG. 1 is a perspective view of a cooking appliance consistent with some embodiments of the invention.

Turning now to the drawings, wherein like numbers denote like parts throughout the several views, FIG. 1 illustrates an example cooking appliance 8 in which the various technologies and techniques described herein may be implemented. Cooking appliance 8 in this embodiment includes multiple components or appliances, including a range 10 and an over-the-range oven 36.

Range 10 includes a housing 12, a stovetop or cooktop 14 including a plurality of cooktop burners 16, and an oven 18 defining a cooking cavity accessed via an oven door 20 having a window 22 and a handle 24. Range 10 may also include a storage drawer 26 in some embodiments, or in other embodiments, may include a second oven. Various cooking elements (not shown in FIG. 1) may also be incorporated into range 10 for cooking food in oven 18, e.g., one or more electric or gas heating elements.

Range 10 may also include various user interface devices, including, for example, control knobs 28 for controlling cooktop burners 16, a control panel 30 for controlling oven 18 and/or cooktop burners 16, and a display 32 for providing visual feedback as to the activation state of the cooking appliance. It will be appreciated that range 10 may include various types of user controls in other embodiments, including various combinations of switches, buttons, knobs and/or sliders, typically disposed at the rear or front (or both) of the cooking appliance, although in some instances, user controls may be disposed at different locations, e.g., along the side of a cooking appliance or grouped near the center of a cooking appliance. Further, in some embodiments, one or more touch or proximity sensitive surfaces may be employed for interaction with a user. As such, in some embodiments, display 32 may be touch sensitive to receive user input in addition to displaying status information and/or otherwise interacting with a user. In still other embodiments, range 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including but not limited to LEDs, vacuum fluorescent displays, liquid crystal displays, etc. Further, in some embodiments audio feedback may be provided to a user via one or more speakers, and in some embodiments, user input may be received via a spoken or gesture-based interface.

As noted above, range 10 combines both a cooktop and one or more ovens, and in some embodiments may be a standalone or drop-in type of range. In other embodiments, however, range 10 may be another type of cooking appliance, e.g., a drop-in cooktop (as discussed in greater detail below in connection with FIG. 3).

In addition, consistent with the invention cooking appliance 8 includes an illumination system, e.g., illumination system 34, which is disposed above cooktop burners 16, e.g., on an underside of over-the-range oven 36, to illuminate generally downwardly onto one or more of cooktop burners 16. An illumination system may include one or more illuminating elements, e.g., LED illuminating elements, incandescent illuminating elements, halogen illuminating elements, fluorescent illuminating elements, laser illuminating elements, or other elements capable of emitting visible light. An individual illuminating element moreover may include multiple emitters in some embodiments, e.g., where LED illuminating elements are formed from multiple LED emitters. Moreover, illuminating elements may be single-color elements in some embodiments, while in other embodiments illuminating elements may be multi-color elements and may in some instances be capable of generating different colors to implement different illuminating schemes and/or to convey different information to a user.

In addition, a user detection system including capacitive contact sensors coupled to each of control knobs 28 (not shown separately in FIG. 1) is provided to detect when a user physically touches any of control knobs 28. In this embodiment, illumination system 34 is powered by and in communication with range 10 via one or more wires (not shown in FIG. 1), although it will be appreciated that in other embodiments, an illumination system may be powered by an overhead appliance (e.g., microwave, oven or vent hood), or may be separately powered.

Oven 36 may be a microwave oven including a control panel 38, and may also include in some embodiments a light (separate from or in addition to illumination system 34) for illuminating the surface of the countertop and/or an exhaust vent for venting cooking odors, heat, smoke, grease and/or moisture. Other types of ovens, e.g., conventional, speed cook or convection ovens, may be used in other embodiments, while in other embodiments, a vent hood may be disposed over range 10 instead of an oven (as discussed in greater detail below in connection with FIG. 3), and in still other embodiments, cabinets may be disposed over range 10 or the area over the range may be otherwise open.

In general, a cooking appliance consistent with the invention may be considered to include any residential-type appliance (or combination of appliances), and disposed within one or more housings. It will be appreciated that for some types of built-in appliances may have exposed portions that are hidden from view when installed, and as such, a housing consistent with the invention may also be considered to include structural and frame members in some embodiments. At least one appliance in a cooking appliance consistent with the invention may include one or more cooktop burners and one or more burner controls configured to control a respective cooktop burner among the one or more cooktop burners. A cooktop burner may be considered to include practically any type of energy-producing heating element used in residential applications in connection with cooking food on a cooktop, e.g., employing various cooking technologies such as electric, induction, gas, etc. Further, it will be appreciated that any number of cooktop burners may be provided in a cooking appliance, and that multiple types of cooktop burners may be combined in some embodiments, e.g., combinations of gas and electric burners in some embodiments. A burner control, in turn, may be considered to include practically any type of user control suitable for controlling a specific cooktop burner, including, for example, a knob, a slider, a touchscreen or touch-sensitive surface, one or more buttons, etc.

Figure 2:
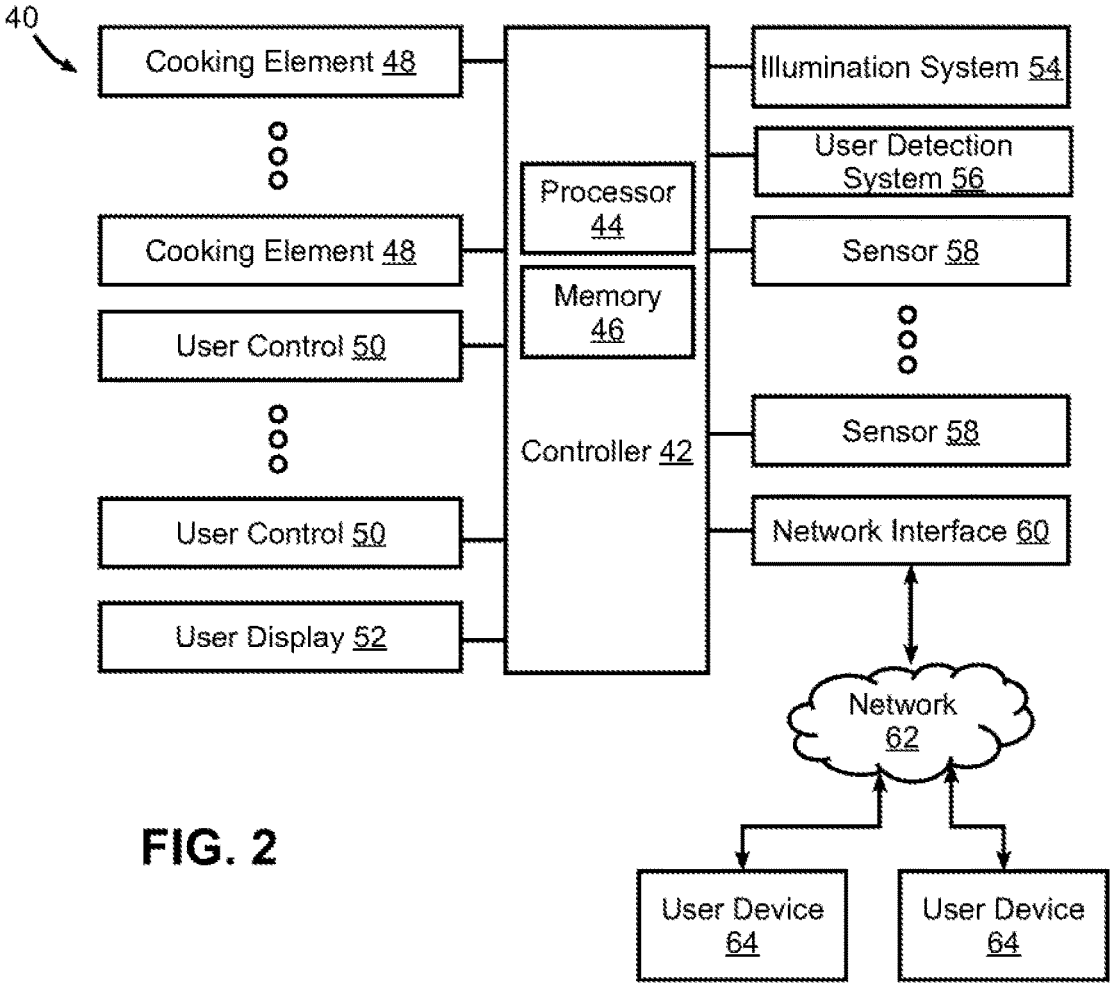
FIG. 2 is a block diagram of an example control system for a cooking appliance consistent with some embodiments of the invention.

A cooking appliance consistent with the invention also generally includes one or more controllers configured to control the cooktop burners and other cooking elements, and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others, including one or more cooktop burners), one or more user controls 50 for receiving user input (e.g., various combinations of switches, knobs, buttons, sliders, touchscreens or touch-sensitive displays, microphones or audio input devices, image capture devices, etc., including one or more burner controls), and a user display 52 (including various indicators, graphical displays, textual displays, speakers, etc.), as well as various additional components suitable for use in a cooking appliance, e.g., lights, fans, indicators, switches, valves, etc., among others.

In addition, controller 42 may be interfaced with an illumination system 54 configured to illuminate one or more cooktop burners using multiple illumination schemes, as will be discussed in greater detail below. Further, a user detection system 56, including one or more sensors, may be used to detect user interaction with one or more burner controls. User detection system 56, for example, may be used to sense a user touching a particular burner control and/or a user reaching toward or placing his or her hand in close proximity to a burner control, and thus may be considered to include practically any user action to engage with a particular burner control, but prior to actually manipulating or adjusting the burner control. Such user actions will hereinafter be referred to as "touch" actions, although it will be appreciated that such actions may include actions that occur prior to actual contact between a user and a burner control. A wide variety of sensor technologies may be used to detect touch actions in various embodiments, including contact-type sensors such as capacitance or continuity sensors, pressure sensors, etc., as well as non-contact or proximity sensors such as infrared, ultrasonic or optical sensors or other sensors capable of detecting gestures. In one example, embodiment, user detection system 56 may include one or more ultrasonic proximity sensors. It will be appreciated that non-contact sensors may be advantageous in some embodiments due to the fact that a user may be alerted as to which cooktop burner is controlled by a particular burner control merely by placing his or her hand close to the burner control and prior to actually touching the burner control.

Controller 42 may also be interfaced with various additional sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments.

In some embodiments, controller 42 may also be coupled to one or more network interfaces 60, e.g., for interfacing with external devices via wired and/or wireless networks such as Ethernet, Wi-Fi, Bluetooth, NFC, optical, cellular and other suitable networks, collectively represented in FIG. 2 at 62. Network 62 may incorporate in some embodiments a home automation network, and various communication protocols may be supported, including various types of home automation communication protocols. Network 62 may also be used to communicate between different components in cooking appliance 40, e.g., between controller 42 and illumination system 54, between controller 42 and user detection system 56, between controller 42 and one or more user controls 50, or even between multiple control modules of controller 42, e.g., in the instance where the functionality of controller 42 is distributed amongst multiple control modules disposed proximate a cooktop and proximate an illumination system.

In some embodiments, cooking appliance 40 may also be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Embodiments consistent with the invention, as mentioned above, are directed in part to the use of an overhead illumination system for a cooking appliance that is capable of illuminating generally downwardly onto the cooktop burners of the cooking appliance using multiple illumination schemes to convey various types of feedback to a user interacting with the cooking appliance.

One problem experienced by many users of cooktops is that of activating a cooktop burner other than the one he or she had intended, and which in some instances may result in no cooking occurring in a pot or pan placed on a particular burner while another burner heats up and presents a hot surface that could burn an unsuspecting user or undesirably heat an object placed on that burner with the expectation that the burner is not currently active. While attempts have been made to use lights or graphics on a cooktop surface to provide some indication to a user as to which burners are active, the lights or graphics often can be obscured by pots, pans or other utensils placed on the cooktop.

Illuminating generally downwardly from an overhead position above a cooktop, on the other hand, may provide a lower risk of obstruction and greater visibility to a user. Further, by applying multiple illumination schemes, different information may be conveyed to a user to provide additional feedback to the user while operating a cooktop.

An illumination system consistent with the invention may therefore include one or more illuminating elements positioned and oriented to illuminate generally downwardly onto one or more cooktop burners of a cooking appliance, and capable of applying different illumination schemes to each cooktop burner to convey different types of information to a user. Generally downwardly, in this regard, refers to illumination that is emitted from an elevation that is generally higher than the surface of a cooktop, and it will be appreciated that in other embodiments, the illumination may be laterally offset from a cooktop burner as well as from a higher elevation (e.g., as illustrated in FIG. 1).

Figure 3:
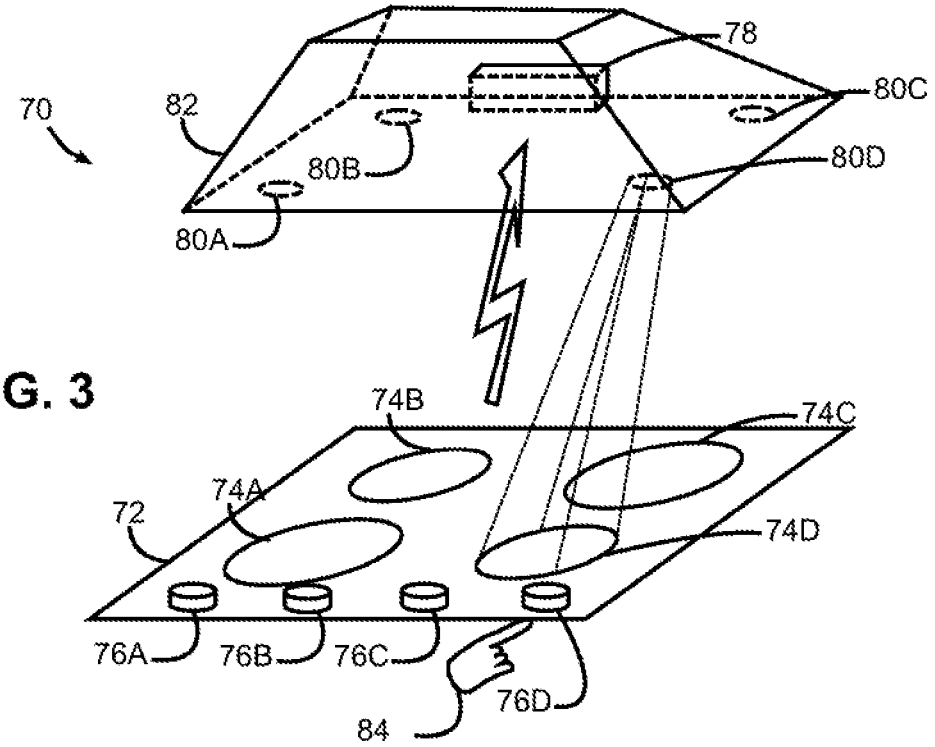
FIG. 3 is a perspective view of another cooking appliance consistent with the invention.

Cooking appliance 8 of FIG. 1 includes each of the aforementioned components, as noted above. However, FIG. 3 illustrates another embodiment of a cooking appliance 70 including a cooktop 72 with a plurality of cooktop burners 74A-74D and corresponding burner controls 76A-76D, as well as a control module 78 and illumination system incorporating a plurality of illuminating elements 80A-80D disposed in a vent hood 82. Cooking appliance 70, like cooking appliance 8 of FIG. 1, includes cooktop burners, burner controls, a user detection system and illumination system; however, cooking appliance 70 also includes a number of variations from cooking appliance 8 to illustrate various different approaches that may be utilized in different embodiments of the invention. For example, rather than being implemented with a cooktop disposed in a range and an illumination system incorporated into an over-the-range oven, cooking appliance 70 includes a standalone or drop-in cooktop 72 and an illumination system incorporated into a vent hood 82.

In addition, rather than implementing an illumination system with illuminating elements disposed at the same location and/or within the same housing, cooking appliance 70 includes illuminating elements 80A-80D are positioned at separate locations. Further, rather than utilizing contact sensors to detect physical contact with a control knob, cooking appliance 70 includes non-contact or proximity sensors (not illustrated separately in FIG. 3) that detect when a user is positioned close to a particular burner control (e.g., hand 84 disposed proximate burner control 76D).

Furthermore, rather than incorporating all control logic within a cooktop or range, at least a portion of the control functionality associated with burner illumination is implemented in cooking appliance 70 using a control module 78 disposed in vent hoot 82. Further, rather than incorporating wired connections between a controller, illumination system and set of burner controls, cooking appliance 70 utilizes wireless communication to convey information between cooktop 72 and control module 78, e.g., to provide notifications of touch actions by a user and/or to provide other status information such as burner activation states and/or temperatures, burner control positions or settings, etc. Wired or wireless connections may also be used between control module 78 and each illuminating element 80A-80D in different embodiments.

Figure 4:
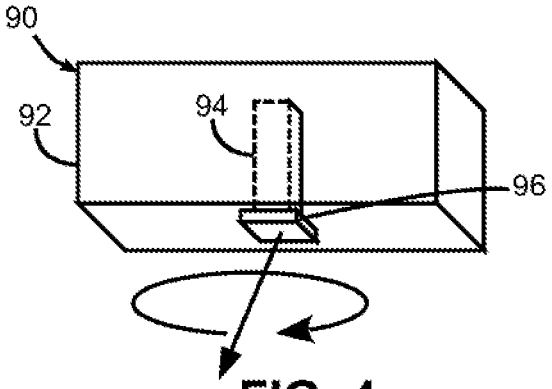
FIG. 4 is a perspective view of a laser-based illumination system consistent with the invention.
Figure 5:
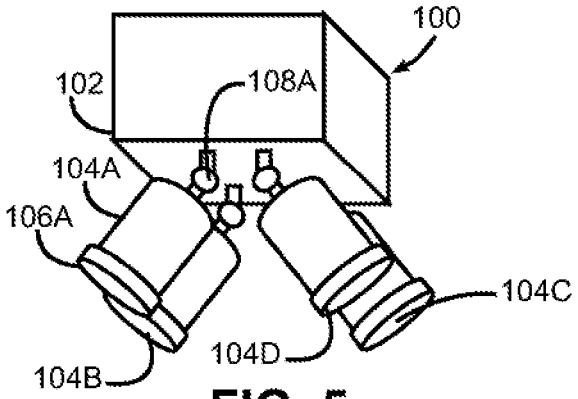
FIG. 5 is a perspective view of an adjustable illumination system consistent with the invention.

FIGS. 4 and 5 also illustrate other suitable implementations. FIG. 4, for example, illustrates a self-contained illumination system 90 including a housing 92 and a laser illuminating element 94 coupled to a movable mirror 96 (e.g., incorporating a digital micromirror) that is capable of reflecting or steering a beam from laser illuminating element 94 to any of multiple cooktop burners. In such a design, a controller incorporated into housing 92 may control movable mirror 96 while modulating the beam from laser illuminating element 94 to "draw" patterns of light onto one or more of the cooktop burners and thereby selectively illuminate the cooktop burners with different illumination schemes. The patterns of light may include solid or flashing regions, curved and/or linear line segments, text, patterns, images, colors, etc. in different embodiments.

FIG. 5, as another example, illustrates a self-contained illumination system 100 including a housing 102 and multiple LED illuminating elements 104A-104D that are dedicated to specific cooktop burners. Each illuminating element 104A-104D may include a variable beam width, e.g., using a manually-adjustable zoom 106A-106D, which can be adjusted to match a size of a corresponding cooktop burner. Each illuminating element 104A-104D may also support a variable orientation, e.g., using ball joints 108A-108D, which can be adjusted to direct a beam position to match the position of a corresponding cooktop burner. It will be appreciated that in other embodiments, beam width and/or position may be adjustable programmatically using appropriate actuators, and a beam may be automatically movable in connection with an illumination scheme in some embodiments.

In both illumination systems 90, 100, the illumination systems are separate from an oven or vent hood, and thus may be used in applications incorporating existing ovens or vent hoods, or where a cooktop is disposed in an open area or under cabinets, e.g., in retrofit applications. With such systems, status information from a cooktop may be communicated wired or wirelessly (e.g., via Bluetooth, Wi-Fi, or other wireless protocols) in some embodiments.

Other variations will be appreciated by those of ordinary skill having the benefit of the instant disclosure. Therefore, the invention is not limited to the particular implementations described herein.

Figure 6:
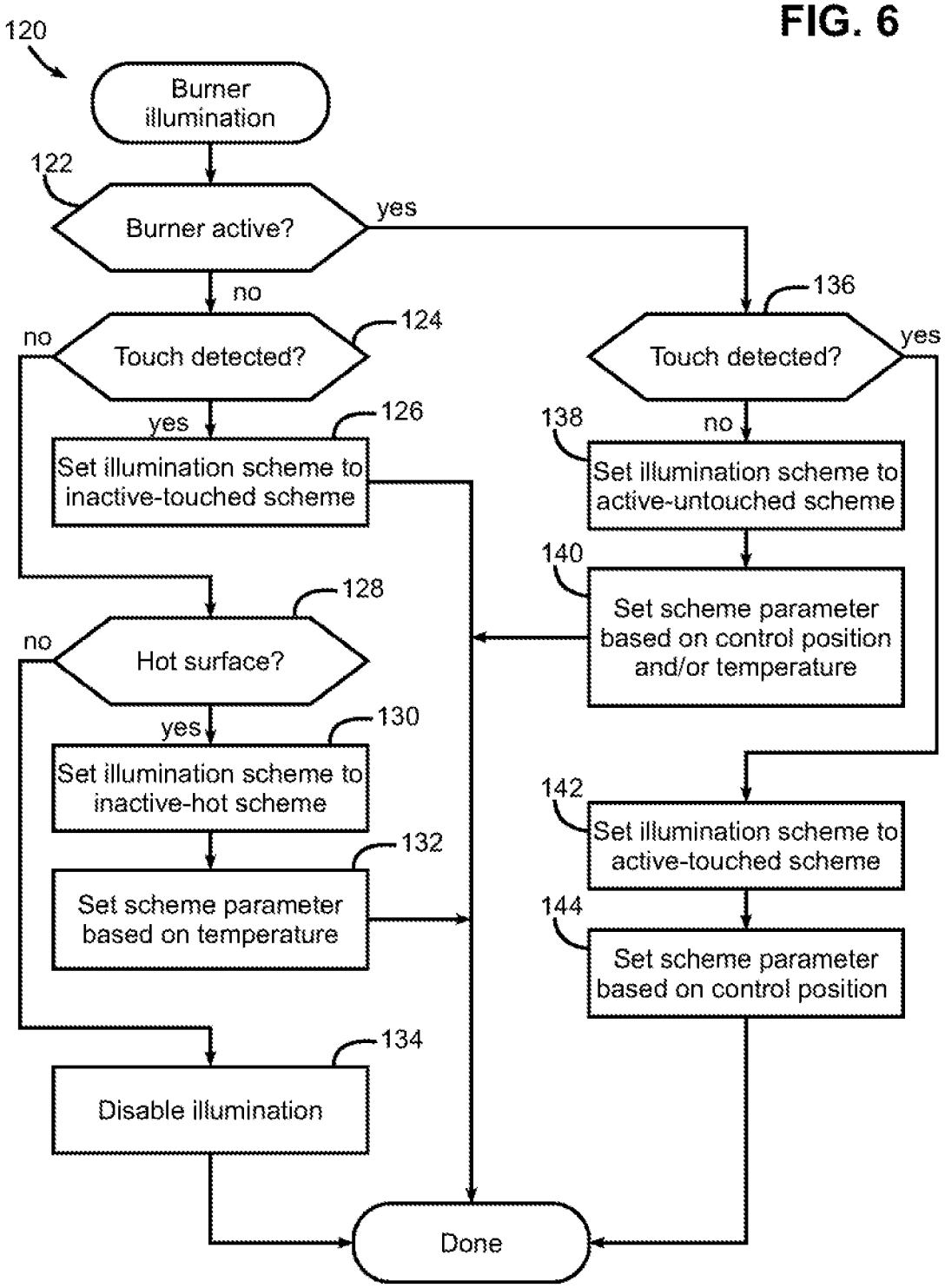
FIG. 6 is a flowchart illustrating an example sequence of operations for illuminating a cooktop burner consistent with the invention.

Now turning to FIG. 6, this figure illustrates an example sequence of operations 120 for controlling the illumination of an individual cooktop burner in any of the embodiments discussed above in connection with FIGS. 1-5. Sequence of operations 120 is specific to an individual cooktop burner, so it will be appreciated that each cooktop burner of a multi-burner cooktop may be controlled using similar sequences of operation. In other embodiments, a single routine may control illumination of all cooktop burners of a cooktop, as in some instances it may be desirable to control the illumination scheme for a particular cooktop burner based upon the current illumination schemes of one or more other cooktop burners.

Sequence 120 supports, in addition to an inactive state where the cooktop burner is not illuminated, four separate illumination schemes. The first illumination scheme is referred to as an "inactive-touched" illumination scheme, which may be used during user interaction with the burner control but prior to activation of the cooktop burner itself, e.g., when the cooktop burner is not currently active and a touch action (either direct contact or proximity) has been detected for a user with the corresponding burner control. The second illumination scheme is referred to as an "active-touched" illumination scheme, which may be used during user interaction with the corresponding burner control while the cooktop burner is currently active, e.g., when the cooktop burner is currently active and a touch action has been detected. The third illumination scheme is referred to as an "active-untouched" illumination scheme, which may be used in the absence of user interaction with the corresponding burner control while the burner is active, and the fourth illumination scheme is referred to as an "inactive-hot" illumination scheme, which may be used when the cooktop burner meets a hot surface criterion when the cooktop burner is currently inactive, typically when the cooktop burner is still hot after being shut off. The hot surface criterion, for example, may be based on a threshold temperature such that when the cooktop burner is above a certain temperature, the "inactive-hot" illumination scheme will be used until the cooktop burner sufficiently cools.

It will be appreciated that in other embodiments, not all illumination schemes may be used, while in other embodiments, additional illumination schemes may be used to convey other status information to a user. Moreover, as will become more apparent below, within a particular illumination scheme, one or more display characteristics of the scheme may vary based upon various inputs or variables. For example, in some embodiments, the "active-untouched" illumination scheme may be variable based on the position of the corresponding burner control and/or the temperature of the cooktop burner, e.g., so that whenever a burner is active a user may be informed via the illumination of the burner of the setting of the burner control or the temperature of the burner itself. Thus, if a user has turned a burner control from a low setting to a high setting, or if the burner has increased in temperature, one or more display characteristics of the illumination scheme may vary to reflect these changes. Similarly, in some embodiments, the "active-touched" illumination scheme may be varied based upon the position of the corresponding burner control, e.g., so that changes in the settings to the cooktop burner will be reflected in the illumination scheme. Moreover, in some embodiments, the "inactive-hot" illumination scheme may be varied based upon the temperature of the burner to reflect not only that the cooktop burner is hot, but how hot the burner is. Other variables may be used to vary the illumination schemes in other embodiments.

Now turning specifically to sequence 120, this sequence may be called, for example, on a regular basis (e.g., multiple times per second) during the operation of a cooking appliance. First, block 122 may determine if the cooktop burner being controlled is currently active, i.e., whether the cooktop burner is currently active and emitting heat or is an inactive state. If not, control passes to block 124 to determine if a touch action has been detected, i.e., whether the presence of a user has been detected either through physical contact of the user with the burner control corresponding to the burner or through a part of the user's body being in close proximity to the burner control (but not necessarily touching). If so, control passes to block 126 to select the "inactive-touched" illumination scheme.

Returning to block 124, if no touch is detected, control passes to block 128 to determine if the hot surface criterion for the cooktop burner has been met, e.g., if the cooktop burner temperature is over a predetermined temperature. If so, indicating that the burner has recently been shut off but is still hot, control passes to block 130 to set the illumination scheme to the "inactive-hot" illumination scheme. Block 132 may also optionally set a parameter for the "inactive-hot" illumination scheme based on the temperature of the cooktop burner, e.g., to indicate how hot the burner is. Returning to block 128, if the hot surface threshold is not met, control passes to block 134, whereby illumination of the cooktop burner is disabled.

Now returning to block 122, if the cooktop burner is active, control passes to block 136 to determine if a touch action has been detected for the corresponding burner control. If not, control passes to block 138 to set the illumination scheme for the cooktop burner to the "active-untouched" illumination scheme, and block 140 may then optionally set a parameter of the scheme based on the position of the corresponding burner control and/or the temperature of the burner. As such, while the burner is active but no user interaction is occurring, the illumination scheme may convey one or both of the current setting of the corresponding burner control or the current temperature of the cooktop burner.

Returning to block 136, if a touch action is detected, control passes to block 142 to set the illumination scheme to the "active-touched" illumination scheme, and block 144 optionally sets a scheme parameter based on the position of the corresponding burner control. Thus, for example, if a user engages a burner control for an active cooktop burner and changes its position, the change in position may be conveyed to the user via the illumination scheme.

It will be appreciated that different combinations of illumination schemes may be used in other embodiments, and therefore, the invention is not limited to the particular sequence of operations illustrated in FIG. 6.

Illumination schemes may vary from one another based upon different display characteristic. For examples, illumination schemes may vary from one another based upon colors, intensity, patterns, text, outlines, icons, graphics, images, and/or animations, among others. Moreover, as noted above, settings or parameters of illumination schemes may vary based upon various inputs, parameters or other data, and such settings or parameters may result in variations in display characteristics in a particular illumination scheme, e.g., based upon colors, intensity, patterns, text, outlines, icons, graphics, images, and/or animations, among others. Moreover, in some instances, an illumination scheme may be associated with no illumination of a cooktop burner in some instances, e.g., it may be desirable to only illumination a burner when a user is interacting with its corresponding burner control.

Figure 7:
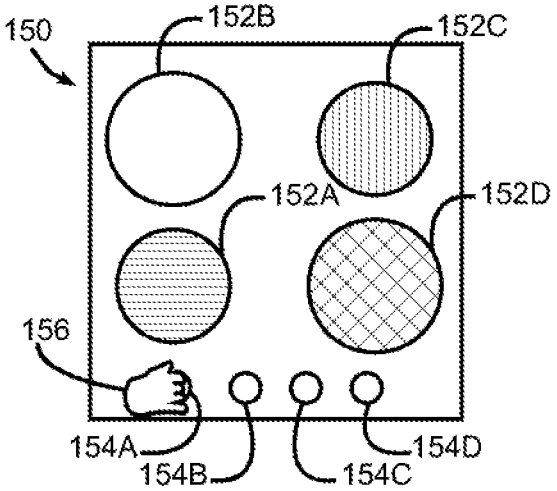
FIG. 7 is a functional top plan view of a cooktop illustrating illumination using multiple illumination schemes consistent with the invention.

Returning to FIG. 3, for example, this figure illustrates an example illumination scheme for cooktop burner 740 in response to a touch action by a user's hand 84 with burner control 760, resulting in the illumination of cooktop burner 740 to indicate to the user that the user is about to touch the burner control for cooktop burner 740. FIG. 7, as another example, illustrates an example cooktop 150 including four cooktop burners 152A-152D with corresponding burner control knobs 154A-154D. For the purposes of this example, cooktop burner 152A is active and its corresponding burner control knob 154A is being adjusted by a user (represented by hand 156), and as a result, cooktop burner 152A is being illuminated with one illumination scheme. Cooktop burner 152B is not active, nor is the temperature of the cooktop burner hot, so cooktop burner 152B is not illuminated. Cooktop burner 152C is currently active, but is not being interacted with by a user, so it is illuminated with a different illumination scheme from cooktop burner 152A. Cooktop burner 152C is inactive, but was previously used and is still hot, and is accordingly illuminated with yet another illumination scheme that differs from those of cooktop burners 152A and 152C.

In one example embodiment, proximity or touching of a burner control may be represented by a solid illumination scheme at a higher intensity and adjustment of a burner control may be represented by a flashing illumination scheme. Temperature may be represented by illumination intensity, and control position may be represented by flash rate such that, for example, when a user touches the corresponding burner control for a particular cooktop burner, the cooktop burner is illuminated at a higher intensity to indicate which cooktop burner the user would control with the burner control, and then once activated, the cooktop burner would be illuminated with a flashing illumination scheme while the user adjusts the control, with the flash rate varied based upon the control setting, whereby a faster flash rate would be indicative of a higher control setting. Once the user released the control, a solid, but lower intensity illumination scheme would be used to indicate that the burner was active, and the illumination intensity may be adjusted as the temperature of the burner increases. Once the burner was deactivated, a lower intensity illumination scheme may continue to be used, with the intensity decreasing as the temperature of the inactive burner decreased. Once the burner temperature fell below a threshold, illumination would be discontinued.

In another example embodiment, different colors may be used in different illumination schemes, such that, for example, a burner would be illuminated with one color when interacted with by a user, illuminated with a different color when active but not being interacted with, and illuminated with yet another color when inactive but still hot. In addition, in some instances the burner temperature could be indicated by a range of colors and/or using a textual representation of the measured temperature in the illumination scheme.

An innumerable number of different illumination schemes may be used in other embodiments, so the invention is not limited to the few illustrative examples mentioned herein. Further, illumination schemes may also incorporate audible sounds in some embodiments. In addition, illumination schemes may also incorporate movement or animation of an illumination pattern.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a plurality of cooktop burners;

a plurality of burner controls, each burner control controlling a respective cooktop burner among the plurality of cooktop burners;

an illumination system positioned above the plurality of cooktop burners to illuminate generally downwardly onto the plurality of cooktop burners; and a controller configured to control the illumination system in response to user interaction with the plurality of burner controls, the controller configured to control the illumination system to:

during user interaction with a first burner control among the plurality of burner controls and prior to activation of a first cooktop burner among the plurality of cooktop burners that is controlled by the first burner control, illuminate the first cooktop burner with the illumination system using a first illumination scheme; and during user adjustment of the first burner control while the first cooktop burner is active, illuminate the first cooktop burner with the illumination system using a second illumination scheme that is different from the first illumination scheme.

2. The cooking appliance of claim 1, wherein the cooking appliance is a range or cooktop.

3. The cooking appliance of claim 1, wherein the illumination system is disposed in a vent hood or an over-the-range oven.

4. The cooking appliance of claim 1, wherein the illumination system is separate from a vent hood or an over-the-range oven.

5. The cooking appliance of claim 1, wherein the illumination system includes one or more LED illuminating elements, incandescent illuminating elements, halogen illuminating elements, fluorescent illuminating elements, or laser illuminating elements.

6. The cooking appliance of claim 1, wherein the illumination system includes an illuminating element with a variable beam width that is adjustable to match a size of a cooktop burner among the plurality of cooktop burners.

7. The cooking appliance of claim 1, wherein the illumination system includes an illuminating element with a variable orientation that is adjustable to direct a beam position to match a position of a cooktop burner among the plurality of cooktop burners.

8. The cooking appliance of claim 1, wherein the illumination system includes an illuminating element and a movable mirror to reflect a beam from the illuminating element at any of the plurality of cooktop burners, and wherein the controller is configured to selectively illuminate each of the plurality of cooktop burners by modulating the beam from the illuminating element.

9. The cooking appliance of claim 1, wherein the first illumination scheme is a solid illuminating scheme and the second illumination scheme is a flashing illumination scheme.

10. The cooking appliance of claim 1, wherein the first illumination scheme illuminates the first cooktop burner with a first color and the second illumination scheme illuminates the first cooktop burner with a second color.

11. The cooking appliance of claim 1, wherein the controller is configured to vary the second illumination scheme in response to a position of the first burner control.

12. The cooking appliance of claim 1, wherein the controller is further configured to control the illumination system to, in an absence of user interaction with the first burner control while the first cooktop burner is active, illuminate the first cooktop burner with a third illumination scheme.

13. The cooking appliance of claim 12, wherein the controller is configured to vary the third illumination scheme in response to a temperature of the first cooktop burner.

14. The cooking appliance of claim 1, wherein the controller is further configured to control the illumination system to, in response to a temperature of the first cooktop burner meeting a hot surface criterion when the first cooktop burner is inactive, illuminate the first cooktop burner with a third illumination scheme.

15. The cooking appliance of claim 14, wherein the controller is configured to vary the third illumination scheme in response to the temperature of the first cooktop burner.

16. The cooking appliance of claim 1, further comprising a user detection system configured to sense user interaction with the first burner control, wherein the controller is detect the user interaction with the first burner control using the user detection system.

17. The cooking appliance of claim 16, wherein the user detection system includes one or more ultrasonic proximity sensors.

18. A cooktop illumination apparatus, comprising:

an illumination system configured to be positioned above a plurality of cooktop burners of a cooking appliance to illuminate generally downwardly onto the plurality of cooktop burners; and a controller configured to control the illumination system in response to user interaction with a plurality of burner controls of the cooking appliance, the controller configured to control the illumination system to:

during user interaction with a first burner control among the plurality of burner controls and prior to activation of a first cooktop burner among the plurality of cooktop burners that is controlled by the first burner control, illuminate the first cooktop burner with the illumination system using a first illumination scheme; and during user adjustment of the first burner control while the first cooktop burner is active, illuminate the first cooktop burner with the illumination system using a second illumination scheme that is different from the first illumination scheme.

19. The apparatus of claim 18, wherein the controller is in wireless communication with the cooking appliance to detect user interaction with each burner control among the plurality of burner controls.

20. A method of operating a cooking appliance of the type including a plurality of cooktop burners disposed on a cooktop surface and a plurality of burner controls, each burner control controlling a respective cooktop burner among the plurality of cooktop burners, the method comprising:

during user interaction with a first burner control among the plurality of burner controls and prior to activation of a first cooktop burner among the plurality of cooktop burners that is controlled by the first burner control, and with an illumination system positioned above the plurality of cooktop burners to illuminate generally downwardly onto the plurality of cooktop burners, illuminating the first cooktop burner using a first illumination scheme such that first status information about the first cooktop burner is displayed within a region of the cooktop surface corresponding to the first cooktop burner; and during user adjustment of the first burner control while the first cooktop burner is active, and with the illumination system, illuminating the first cooktop burner using a second illumination scheme that is different from the first illumination scheme such that second status information about the first cooktop burner is displayed within the region of the cooktop surface corresponding to the first cooktop burner.

21. The method of claim 20, wherein the illumination system includes an illuminating element and a movable mirror to reflect a beam from the illuminating element at any of the plurality of cooktop burners, the method further comprising selectively illuminating each of the plurality of cooktop burners by modulating the beam from the illuminating element.

22. The method of claim 20, wherein the first illumination scheme is a solid illuminating scheme and the second illumination scheme is a flashing illumination scheme.

23. The method of claim 20, wherein the first illumination scheme illuminates the first cooktop burner with a first color and the second illumination scheme illuminates the first cooktop burner with a second color.

24. The method of claim 20, further comprising varying the second illumination scheme in response to a position of the first burner control.

25. The method of claim 20, further comprising controlling the illumination system to, in an absence of user interaction with the first burner control while the first cooktop burner is active, illuminate the first cooktop burner with a third illumination scheme.

26. The method of claim 25, further comprising varying the third illumination scheme in response to a temperature of the first cooktop burner.

27. The method of claim 20, further comprising controlling the illumination system to, in response to a temperature of the first cooktop burner meeting a hot surface criterion when the first cooktop burner is inactive, illuminate the first cooktop burner with a third illumination scheme.

28. The method of claim 27, further comprising varying the third illumination scheme in response to the temperature of the first cooktop burner.

* * * * *